United States Patent [19]

Coleman

[11] 4,108,435

[45] Aug. 22, 1978

[54] PORTABLE RUNWAY WITH LONGITUDINAL SUPPORTS AND TENSION HOLDING MEANS

[76] Inventor: James T. Coleman, P.O. Box 1341, Paducah, Ky. 42001

[21] Appl. No.: 704,523

[22] Filed: Jul. 12, 1976

[51] Int. Cl.[2] ..... A63B 67/00

[52] U.S. Cl. ..... 273/55 R

[58] Field of Search ..... 273/55 R, 26 A, 127 B, 273/55; 272/3; 52/292, 299

[56] References Cited

U.S. PATENT DOCUMENTS

| | | | |
|---|---|---|---|
| 2,270,957 | 1/1942 | Mears | 273/29 A |
| 2,726,866 | 12/1955 | Nally | 52/299 |
| 3,312,467 | 4/1967 | Dawson | 273/26 A |
| 3,433,480 | 3/1969 | Coleman et al. | 273/55 R |

FOREIGN PATENT DOCUMENTS

| | | | |
|---|---|---|---|
| 1,054,359 | 4/1959 | Fed. Rep. of Germany | 272/3 |
| 2,226,599 | 1/1973 | Fed. Rep. of Germany | 273/29 A |

*Primary Examiner*—Richard C. Pinkham
*Assistant Examiner*—T. Brown
*Attorney, Agent, or Firm*—Lowe, King, Price & Markva

[57] ABSTRACT

A training device for practice running is disclosed having an elongated framework supporting a latticework made of resilient crosslines and a resilient intersecting center line positioned above the ground to define spaces in which the runner is to place his feet during use. The latticework is resilient to prevent tripping and injury to the runner and to retain the framework in a stable, assembled, condition without using fasteners. Support members of the framework are generally U-shaped and are connected transversely and longitudinally to support horizontal, opposed side members. The training device provides a portable runway formed by a framework of multiple detachable sections. The transverse, u-shaped support members are located only at the connection of the sections to thereby establish a running course which is free of obstacles below the lattice work and between each of the u-shaped cross members.

6 Claims, 3 Drawing Figures

10
11
12
13
14
15
16
17
18
19
20
21
22
23
24
25
25a
26
27
P
G
3

PORTABLE RUNWAY WITH LONGITUDINAL SUPPORTS AND TENSION HOLDING MEANS

FIELD OF THE INVENTION

The present invention pertains to athletic training devices and, more particularly, to an improved portable runway device for use by a runner to practice running on a generally flat surface.

BACKGROUND OF THE INVENTION

In the training of running sports, it has been determined that exercise, including stationary or mobile running wherein the knees are raised above normal running height will result in conditioning of leg muscles in the back and abdomen. It is also desirable to have the players practice running in such a manner as to improve the coordination between the eyes and the feet to make the runner more agile. Such an exercise has proven to be especially beneficial in the game of football wherein broken field running is needed to elude potential tacklers.

One prior art method of conditioning runners consisted of setting up a running course by laying down and fastening a number of old tires wherein the athlete would attempt to step within the area surrounded by the tires as he negotiated the course. The tires and other prior art devices suffered from the disadvantage of immobility and being unsafe. That is, while these devices have been generally accepted by trainers, they require many man hours to assemble, and they are unsafe and inconvenient to move when the turf within the designated stepping area becomes worn or muddy and slippery. In my prior invention, now U.S. Pat. No. 3,433,480, I overcame the general safety and mobility problems, but my device ended up having a large number of supporting U-shaped members extending transverse of the running course. Thus, while my device is many times safer than previous devices, these cross members coming in rapid succession to the runner as he proceeds along the course, has caused more of a chance of injury than I would like.

SUMMARY OF THE INVENTION

Briefly summarizing the concepts of the present invention, there is provided a training device having a framework defining a practice runway with a latticework of resilient lines being supported by the framework so as to designate the spaces in which the runner is to place his feet during use of the device. As the runner negotiates the runway within the framework, he must avoid the latticework of resilient lines connected within the framework. Preferably, the framework comprises a pair of opposed side members which generally define the running course. According to the invention, the side members are connected and supported by only one generally U-shaped cross member per section, making it considerably easier for the runner to miss stepping on them. The side members are advantageously further supported by longitudinal U-shaped members extending straight downward therefrom out of the running path. The preferred embodiment of the invention is made in sections and the parts are detachable to make the runway easier to transport and easier to store when not in use. The framework is most efficiently fabricated from suitable size metal pipe or tubing.

For the purposes of connecting the sections, the U-shaped cross members comprise a tubular sleeve on each end thereof, such sleeves having an inside diameter of sufficient size to telescopically receive the side members in mating relationship. All of the parts are interchangeable with like parts in the assembly. When the resilient latticework is attached to the framework it becomes an integral part of the framework since the tension of the resilient lines assists in holding the framework together without any additional fasteners. The combination of the tension with the inherent friction of closely fitted parts provides sufficient binding force to prevent the telescoped parts from separating.

In my prior invention, now U.S. Pat. No. 3,433,480, I overcame most of the disadvantages of the prior art by providing a portable, easily assembled, runway device. In this invention, I have further improved the construction to facilitate the assembly and disassembly of the device as well as to improve its safety and efficiency.

OBJECTIVES OF THE INVENTION

Accordingly, it is one object of the present invention to provide an improved training device for athletes.

It is another object of the present invention to provide a runway device for relatively simple construction for ease and economy of manufacture and assembly of the same.

A further object of my invention is to provide a leg muscle conditioning and coordination improving device which can be readily assembled and disassembled and is easily portable.

A still further object of the present invention is to provide a portable, lightweight device which is easily stored and transported and is of rugged construction for rough use.

Still other objects and advantages of the present invention will become readily apparent to those skilled in this art from the following detailed description, wherein I have shown and described only the preferred embodiments of the invention, simply by way of illustration of the best mode contemplated by me of carrying out my invention. As will be realized, the invention is capable of other and different embodiments, and its severed details are capable of modification in various obvious respects, all without departing from the invention.

Accordingly, the drawings and description are to be regarded as illustrative in nature, and not as restrictive.

DETAILED DESCRIPTION OF THE PREFERRED EMBODIMENT

Figures 1, 2, 3:
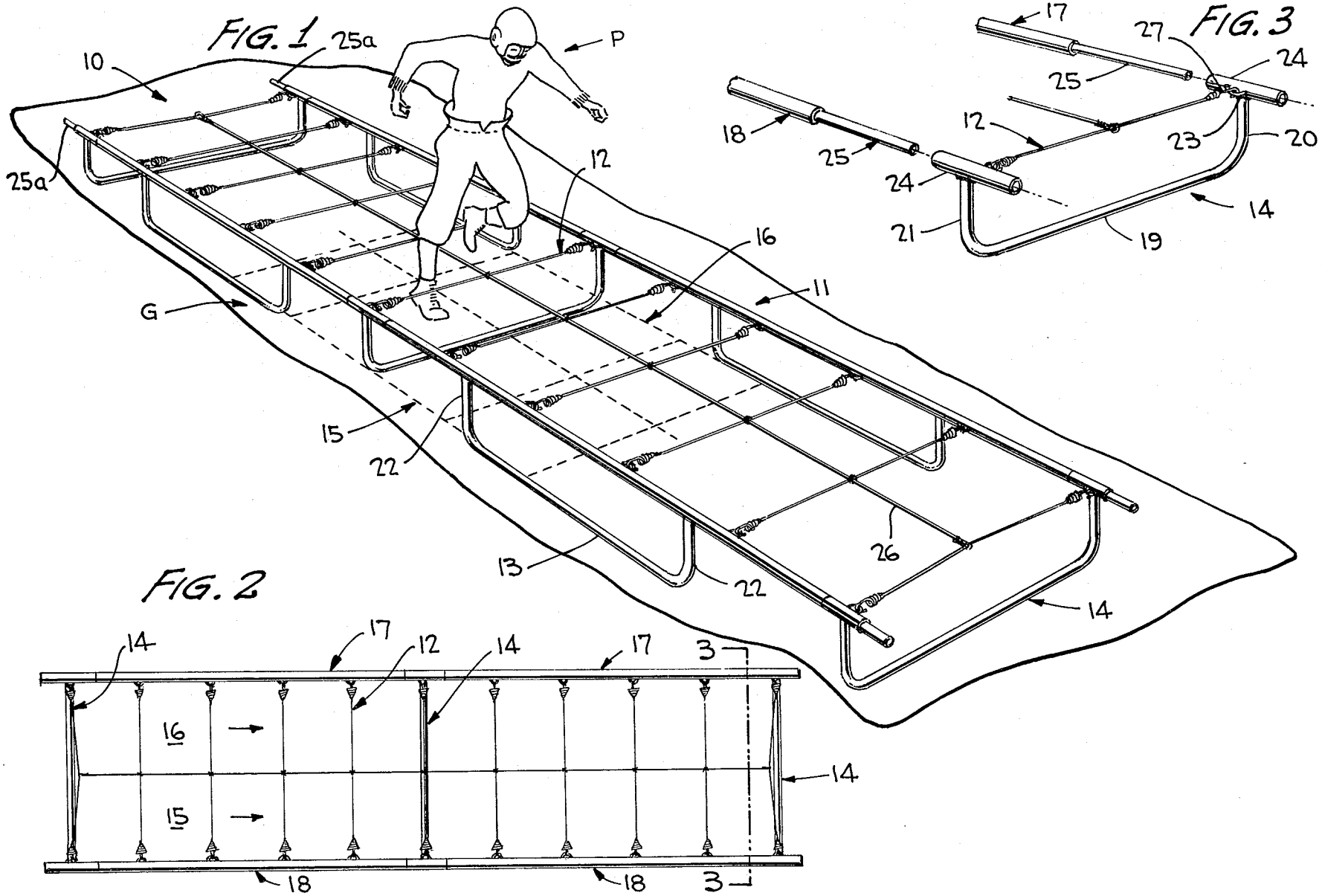
FIG. 1 shows an overall perspective view of the deivce in use.
FIG. 2 is a top view of the device of FIG. 1 showing the sectionalized constructions.
FIG. 3 is a fragmentary section illustrating a suitable structure to form the connection for plural sections of said device.

Proceeding now to give a more detailed description of the construction of the apparatus of the present invention and the advantages gained thereby, reference can be made to FIG. 1 wherein is shown a runway 10 which comprises an elongated framework 11 supporting a latticework 12 and being supported in horizontal position by U-shaped longitudinal members 13 and U-shaped cross members 14. The latticework 12 defines a series of right and left hand spaces 15 and 16 on a generally flat surface G; it being understood that the surface G would normally be the ground if the runway 10 is to be used outdoors and would be the gym floor or equivalent, if the runway 10 is to be used for indoor practice. As mentioned above and clearly shown in this figure, the intended use of the runway 10 is for running practice by a runner or player P, who proceeds along the course of the runway 10 by placing his feet in the designated spaces 15 and 16 in the well known high-stepping fashion to clear the latticework 12. As is apparent, this running exercise is most effective to improve the coordination and thus the agility of the player P. After practice with the runway 10, the coordinated movement of the runner P with the placement of the feet in spaces 15 and 16 in the proper manner is increasingly automatic, as desired.

As best shown in FIGS. 1–3, the framework 11 includes left side members 17, right side membes 18, U-shaped cross members 14, and U-shaped longitudinal members 13 attached to the side members and extending substantially directly below and outside said spaces 15, 16. The side members 17 and 18 are supported in the illustrated fashion by a minimum, indeed only one of the cross members 14 per section, and at least two of the longitudinal members 13. The members 13 and 14 are preferably fabricated of a single section bent in such a manner as to have a central portion 19 adapted to rest on the surface G so as to support the framework 11 and have upstanding legs 20 and 21 for supporting the respective side members 17, 18 at a predetermined height above the surface G.

The U-shaped longitudinal and cross members 13, 14 are most efficiently fabricated from suitable size metal pipe or tubing, as shown, with the joints formed by bending although it is to be understood, of course, that any equivalent construction could be used if desired. The U-shaped longitudinal members 13 are preferably positioned on the underside of the side members 17, 18 as shown in FIG. 1. The legs 22 of longitudinal members 13 are suitably affixed to members 17, 18, such as by welding and are positioned along the length of members 17, 18 to provide the greatest support. The location and length of the longitudinal members 13 will be dependent upon the length of the side members 17, 18.

For ease of manufacture, the longitudinal members 13 are substantially the same as the U-shaped cross members 14. The principal function of the longitudinal members 13 is to protect the side members 17, 18 from bending due to the weight of a player P who may accidentally fall on the side member.

The latticework 12 is connected to generally horizontally disposed, C-shaped loops 23 welded or otherwise suitably attached on the inside of the side members 17, 18, as shown in FIGS. 1 and 3. This particular positioning of the loops assists in directing the force applied by the tension of the latticework 12 to increase the holding force at the connection of the cross members 14 and the side members 17, 18.

For ease of storing and transferring, the runway 10 is formed in sections each section being defined by one length of the side members 17, 18. For the purpose of connecting the sections, suitable tubular sleeves 24 are shown (note FIG. 3) which are welded to U-shaped cross members 14. The tubular sleeves 24 have an inside diameter of sufficient size to telescopically receive the end sections 25 of side members 17, 18 in mating relationship and form a joint therewith. The end sections 25 may be of an outside diameter smaller than the inside diameter of the side members 17, 18 but of sufficient size to form a relatively tight fit when inserted into side members 17, 18. For a permanent attachment, the end sections 25 may be welded to the side members 17, 18. Extra end sections **25*a* are placed in the first end of the runway to hold the initial cross member (see FIG. 1). From here, any number of sections may be added. The side members 17, 18 are interchangeable with like parts. The cross members 14 are also usable on either end or in the middle of the runway 10**.

The interchangeability of the parts will greatly aid in assembly of the various sections. The assembler need only locate the C-shaped loops 23 pointing towards each other and then begin assembling the runway 10 by placing the cross members 14 as shown in FIG. 1.

As shown, latticework 12 preferably includes an assembly of shock cord 26. FIG. 3 shows one type of cone wire hook 27 which may be used to attach latticework 12 to C-shaped loops 23. It is clear from the drawing and the description so far that the shock cords 26 extending cross-wise from the inwardly directed loops 23 and longitudinally in the area of the joint formed between the sections including tubular sleeves 24, side members 17, 18 and reduced end sections 25 of side members 17, 18 (see FIG. 3). The shock cords 26 thus exert a pull tending at all times to keep the joint closed, as shown in FIG. 1. The inward force on side members 17, 18 frictionally binds these telescoping parts together by urging one part against the mating side of the other thereby increasing the frictional holding force. If the player P steps on the cords 26 adjacent the joint, the tendency is to close the joint and add greater holding force since the tension in the cords is increased.

Marine type shock cord is particularly suited for this application since it provides the elastic quality of stranded rubber and the protection inherent in the braided nylon. The shock cord 26 or other resilient material selected for latticework 12 should have sufficient stretchability or flexibility to stretch sufficiently to allow the runner's feet to touch the ground in the normal manner if he accidentally places his feet directly on the lines of the latticework 12. Serious injury such as jamming of the leg joints of the runner P might occur in certain prior art running devices which were rigid. In addition, the important safety feature is added wherein the entire latticework 12 is capable of giving upon the occasion of a runner P tripping and falling into said latticework 12. Most importantly, in the present improvement invention, the number of cross members 14 has been held to an absolute minimum; i.e. only one per section. The runner can easily avoid these since they do not occur in rapid succession as before.

Thus, from the foregoing description it can be seen that the runway 10 of the present invention offers certain results and advantages in that it is of relatively simple construction for economy, particularly constructed for ease of assembly and of portability and is safe for use by runners of all ages.

In this disclosure, there is shown and described only the preferred embodiments of the invention and some changes may be made in the construction and arrangement of my invention without departing from the real spirit and purpose of my invention. It is to be understood that the invention is capable of various changes or modifications within the scope of the invention concept as expressed by the accompanying claims.

What is claimed is:

1. A portable runway for use by a runner to practice running along a course on a generally flat surface comprising, an elongated framework including a plurality of opposed side members forming multiple sections, means for detachably connecting said side members along each side to provide assembly of said sections, cross members adapted to support said side members in a spaced relationship to each other and in spaced relationship to said flat surface, separate longitudinal members adapted to support said side members in a spaced relationship to said flat surface, said cross support members being of generally U-shaped configuration and extending across said running course only at said connection of said side members, means connected to said framework and forming a latticework at a predetermined height above said surface and at predetermined spaced intervals to define spaces along said course in which the runner is to place his feet during use for high stepping running, said running course being free of obstacles below said lattice work and between each of said cross members, to allow freedom of movement of the runner, said longitudinal support members extending substantially directly below said side members and outside said course to prevent the runner from stepping thereon, and resilient means on said latticework means having sufficient resiliency to yield sufficiently to permit the runner's feet to engage said surface along said course when stepped on.

2. The runway of claim 1 wherein said U-shaped cross members are adapted to support said side members only at relatively widely spaced intervals with the separate longitudinal support members in between, said longitudinal support members being of generally U-shaped configuration.

3. The runway of claim 2 wherein said resilient means comprises shock cord.

4. A portable runway for use by a runner to practice running on a generally flat surface comprising, an elongated framework including a plurality of opposed side members forming multiple sections, the ends of said side members terminating in an end of reduced size, cross members terminating in horizontal sleeves for telescopically receiving and retaining said reduced size ends to form said multiple sections, said cross members adapted to support said side members in a spaced relationship to said flat surface, said cross members extending across said runway only at said ends of each of said side members and being of generally U-shaped configuration, means connected to said framework and forming a latticework at a predetermined height above said surface and at predetermined spaced intervals to define spaces in which the runner is to place his feet during use, and resilient means on said latticework means having sufficient tension to hold said reduced ends, sleeve and open end of the side members of said framework in an assembled condition and sufficient resiliency to yield sufficiently to permit the runner's feet to engage said surface when stepped on.

5. The runway of claim 4 wherein said resilient means comprises shock cord.

6. The runway of claim 5 wherein said side members and the horizontal sleeves of said cross members include inwardly directed attaching loops that in combination with the resilient means retain said runway in an assembled condition.

* * * * *